US005775274A

United States Patent [19]

Duret et al.

[11] Patent Number: 5,775,274

[45] Date of Patent: Jul. 7, 1998

[54] TWO-STROKE ENGINE WITH AIR-BLAST FUEL MIXTURE INJECTION

[75] Inventors: Pierre Duret, Sartrouville; Thierry Colliou, Le Chesnay, both of France

[73] Assignee: Institut Francais du Petrole, Rueil-Malmaison, France

[21] Appl. No.: 817,202

[22] PCT Filed: Oct. 6, 1995

[86] PCT No.: PCT/FR95/01303

§ 371 Date: Apr. 11, 1997

§ 102(e) Date: Apr. 11, 1997

[87] PCT Pub. No.: WO96/11333

PCT Pub. Date: Apr. 18, 1996

[30] Foreign Application Priority Data

Oct. 11, 1994 [FR] France ..... 94 12196

[51] Int. Cl.[6] ..... F02B 25/04; F02B 29/00

[52] U.S. Cl. ..... 123/73 A; 123/65 VB

[58] Field of Search ..... 123/73 R, 73 A, 123/73 B, 73 AB, 65 VB, 65 BA

[56] References Cited

U.S. PATENT DOCUMENTS

| | | | |
|---|---|---|---|
| 1,893,035 | 1/1933 | Pawlikowski | 123/65 VB |
| 2,256,437 | 9/1941 | Kylen | 123/73 AB |
| 3,168,890 | 2/1965 | Eilert | 123/73 AB |
| 4,829,958 | 5/1989 | Duret | 123/71 R |
| 4,864,979 | 9/1989 | Eickmann | 123/65 VB |
| 4,995,349 | 2/1991 | Tuckey | 123/65 VB |
| 5,027,757 | 7/1991 | Pusic | 123/65 VB |
| 5,062,396 | 11/1991 | Duret et al. | 123/73 BA |
| 5,072,699 | 12/1991 | Pien | 123/65 VC |
| 5,249,557 | 10/1993 | Katoh et al. | 123/305 |
| 5,586,523 | 12/1996 | Kawahara et al. | 123/73 BA |

FOREIGN PATENT DOCUMENTS

| | | |
|---|---|---|
| 0577451 | 1/1994 | European Pat. Off. . |
| 2057562 | 4/1981 | United Kingdom . |
| 2115485 | 9/1983 | United Kingdom . |

*Primary Examiner*—David A. Okonsky

*Attorney, Agent, or Firm*—Antonelli, Terry, Stout & Kraus, LLP

[57] ABSTRACT

The present invention is an air-blast fuel injection two-stroke engine comprising at least one cylinder (1) in which moves a piston (2) defining a combustion chamber (14) and a pump crankcase (5) forming a continuation of the combustion chamber and separated therefrom by the piston (2), at least one main air inlet (7) in the pump crankcase that can be equipped with a first nonreturn device (6), a device for introducing the fuel mixture at a given pressure, comprising a mechanism (20) for opening and for closing a port (12) for introducing the fuel mixture into the combustion chamber (14), a container (15) connected to the introduction port (12) and containing the fuel mixture under pressure. The engine further comprises a mechanism (30–34) for sucking and introducing the fuel mixture under pressure into the container.

20 Claims, 4 Drawing Sheets

TWO-STROKE ENGINE WITH AIR-BLAST FUEL MIXTURE INJECTION

FIELD OF THE INVENTION

The present invention relates to two-stroke engines with air-blast fuel injection.

DESCRIPTION OF THE PRIOR ART

In engines, for example, as described in French Patent 2,656,653, fuel is introduced by means of a proportioning device located upstream from the point where it will be sprayed by a compressed gas, and the spraying process, that can also be referred to as air-blast injection, is performed directly in the combustion chamber. Besides, a scavenging of the cylinder is performed independently of the air-blast injection with air and/or residual burnt gases.

According to this prior art, the fuel is thus proportioned upstream from its point of injection.

Furthermore, it must be introduced under pressure by an appropriate injection device, which constitutes an additional function and cost.

Stratified charge two-stroke engines are also known, i.e. engines having two separate supplies, an air supply and a fuel-air mixture supply. According to document U.S. Pat. No. 4,253,433, the supplies are performed at the level of the pump crankcase. The term "stratified charge" is used for these engines because one tries to avoid the mixing of the two charges therein, the air charge and the fuel-air mixture charge. The fuel mixture charge is generally introduced into the combustion chamber at a point distant from the exhaust, through a port uncovered by the piston, in a preferred direction, towards the ignition plug for example. The air charge is thus interposed between the exhaust and the fuel mixture charge so as to prevent the latter from reaching the exhaust before it has been entirely burned.

It is unfortunately known from experience that unburned fuel is often discharged through the exhaust with this type of engines. In fact, according to the above-cited patent, the carburetted charge is introduced rather early in the cycle, at the same time as the air charge, so that despite all the precautions taken, the two charges mix and unburned fuel therefore reaches the exhaust.

Because antipollution standards are becoming increasingly severe, notably in the industrialized countries, it is urgently needed that so-called "clean" two-stroke engines be designed, i.e. without unburned fuel discharge and without pollution through hydrocarbons.

SUMMARY OF THE INVENTION

The present invention notably proposes a solution to this problem.

Furthermore, the invention is based on a technology using simple and well-tried devices so that its reliability and its cost are very advantageous.

Besides, as stated above, one drawback of air-blast injection engines is that they require injection of fuel under pressure.

The present invention provides a simple solution which requires no high pressure injector and which preferably uses for example a conventional carburetor associated with a low pressure induction.

SUMMARY OF THE INVENTION

The present invention is thus a two-stroke engine with air-blast fuel injection comprising at least one cylinder in which moves a piston defining a combustion chamber and a pump crankcase forming a continuation of the combustion chamber and separated therefrom by the piston, at least one main air inlet in the pump crankcase that can be equipped with a nonreturn device, an air-blast fuel injection device comprising a specific mechanism for controlling the opening and the closing of a system for introducing the fuel mixture into the combustion chamber, a container connected to the introduction system and containing the fuel mixture under pressure.

According to the invention, the engine further comprises a mechanism for sucking and introducing the fuel mixture under pressure into the container.

More precisely, the suction mechanism comprises a secondary air delivery pipe into which opens a carburetor and equipped with a first nonreturn device located downstream from the carburetor, the pipe opening downstream from the nonreturn device into at least one pipe connecting the container to the pump crankcase and a second nonreturn device provided between the container and the pipe.

The secondary air delivery pipe preferably opens into the linking pipe close to the container.

The linking pipe advantageously opens, by its end opposite that opening into the container, either directly into the pump crankcase, or into a port of the cylinder co-operating at certain periods of the working cycle with a port of the piston.

According to one of its characteristics, the dimensions of the secondary air delivery pipe are such that the volume of the inducted fuel mixture remains lower than the volume of the linking pipe in order notably to prevent the fuel mixture from being driven back into the pump crankcase.

According to another one of its characteristics, the volume of the linking pipe is greater than the volume occupied by the inducted fuel mixture necessary for each engine revolution.

Besides, the engine according to the present invention can have a device for introducing a lubricant simultaneously with the main air supply.

According to one of the embodiments of the invention, the linking pipe can be equipped with a supple separation membrane whose displacements depend on the pressure in the pump crankcase.

The invention relates for example to a multicylinder engine as defined above and comprising a single secondary air delivery pipe, a single carburetor, the pipe feeding several pipes co-operating each with a cylinder.

BRIEF DESCRIPTION OF THE DRAWINGS

Other features and advantages of the invention will be clear from reading the description hereafter, given by way of non limitative examples, with reference to the accompanying drawings in which.

DESCRIPTION OF THE PREFERRED EMBODIMENTS

Figure 1:
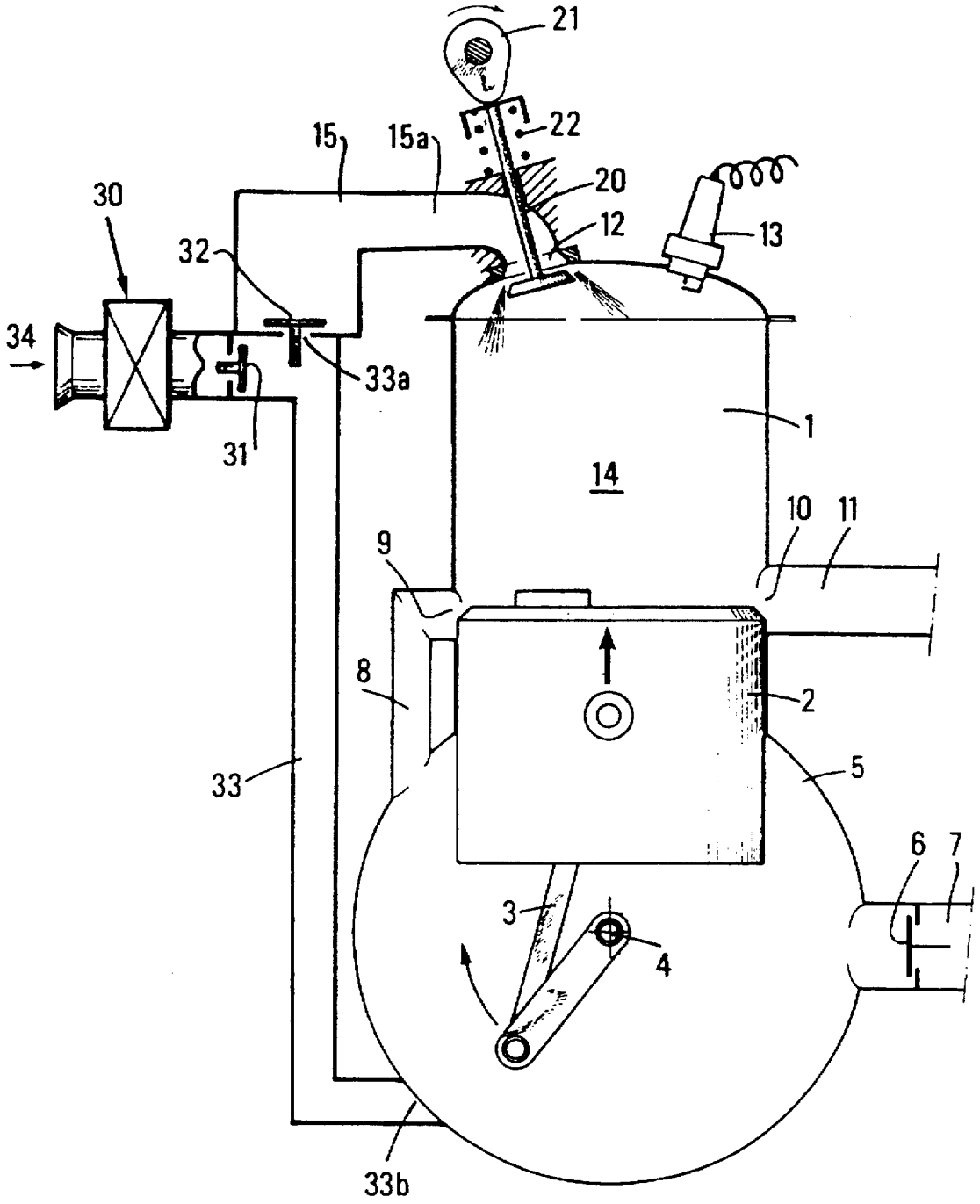
FIG. 1 is a simplified longitudinal section of an embodiment of the invention.

The two-stroke engine shown in FIGS. 1 to 3 comprises, as it is known in the art, at least one cylinder 1 in which moves a piston 2 defining a combustion chamber 14 above and a pump crankcase 5 below. The piston is connected to the crankshaft 4 of the engine by an articulated rod 3.

Figure 2:
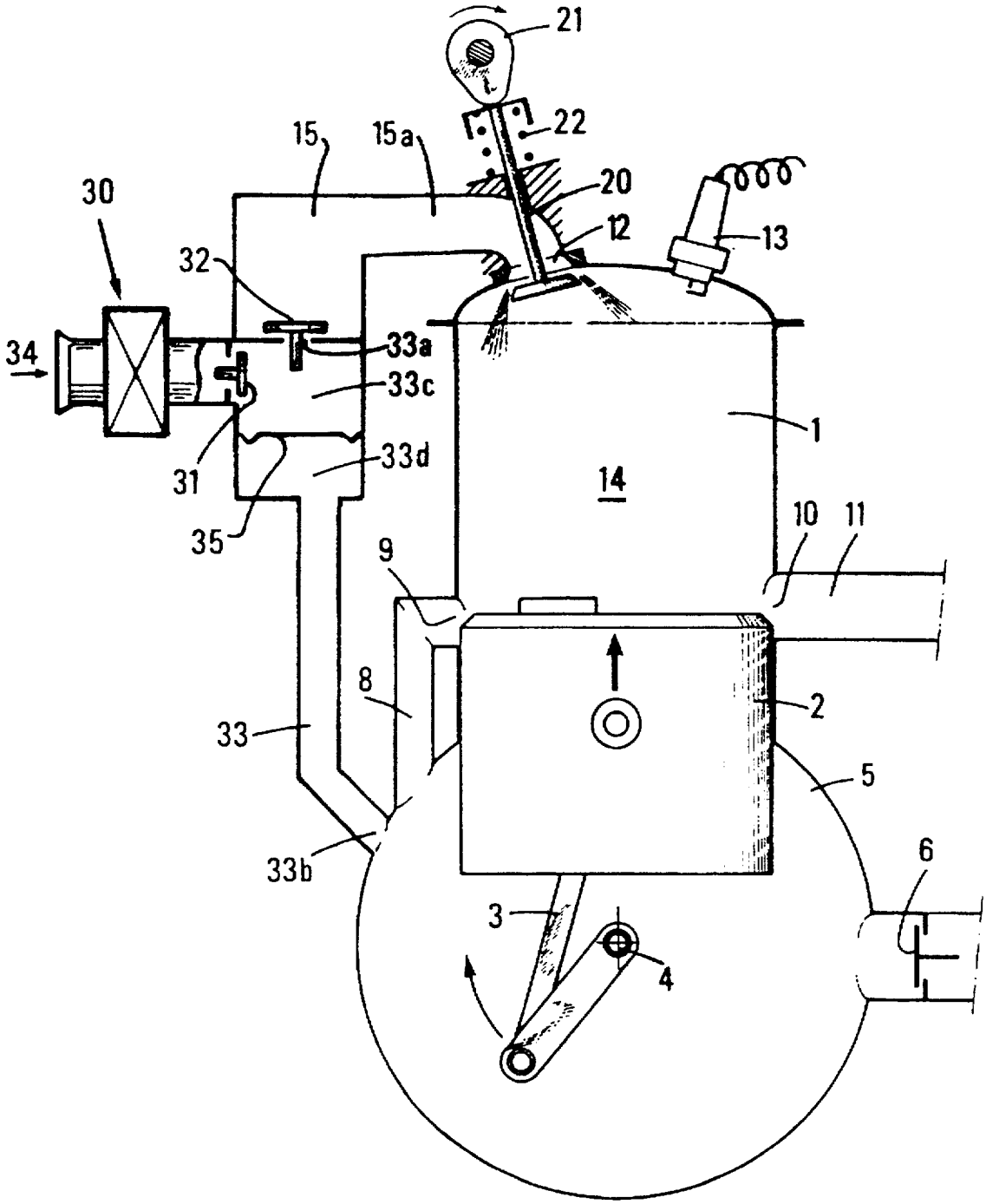
FIG. 2 is a simplified longitudinal section of another embodiment of the invention.
Figure 3:
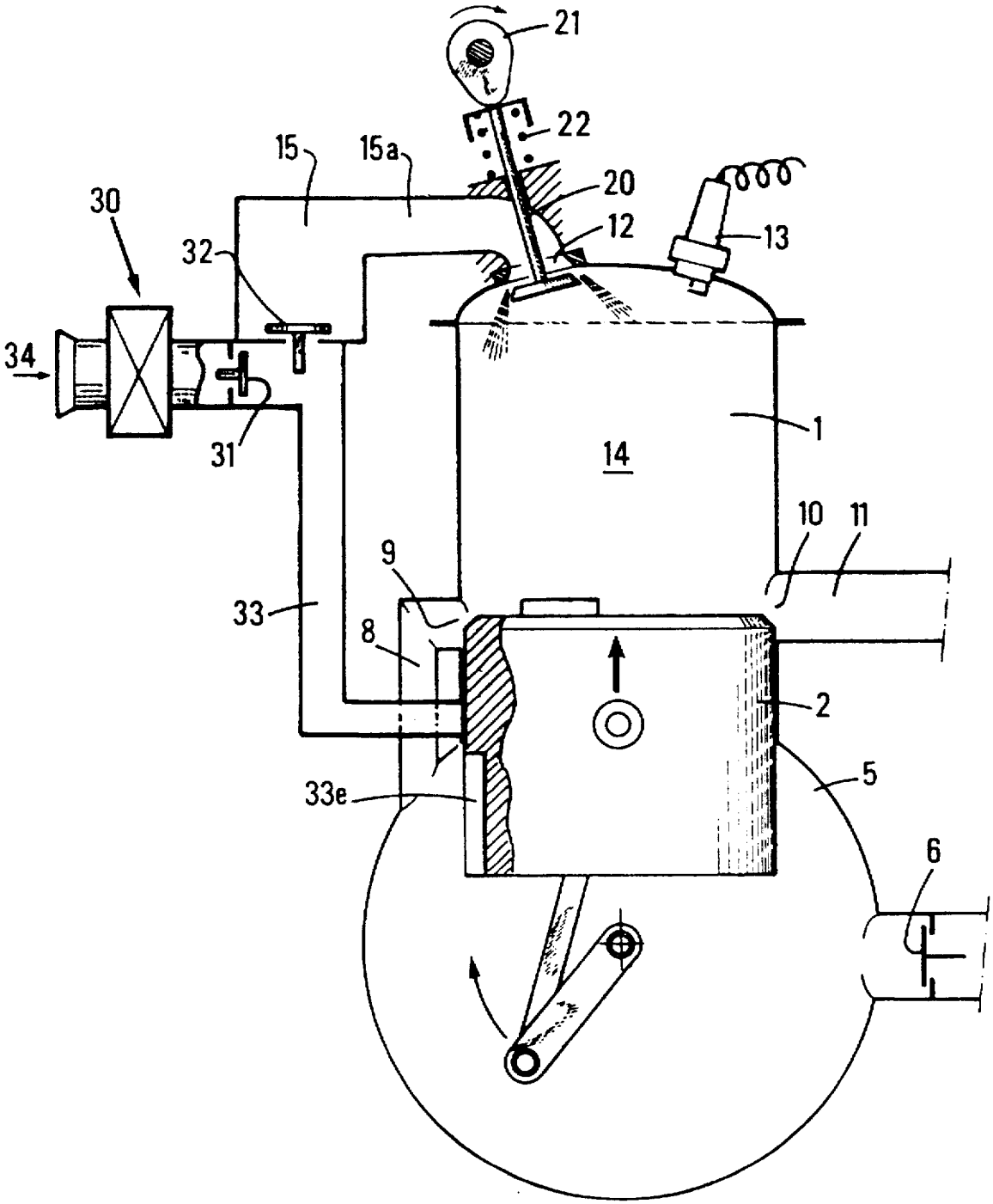
FIG. 3 shows, by means of a simplified longitudinal section of another embodiment of the invention.

A port 7 or air supply nozzle associated with a nonreturn valve 6 allows the inflow of atmospheric air when the pump crankcase 5 is underpressured, i.e. when piston 2 moves upwards as shown by the arrow in FIGS. 1 to 3.

One or several transfer pipes 8 connect the pump crankcase 5 to the combustion chamber 14 and transfer the uncarbureted gas (air) from the pump crankcase to the combustion chamber 14 via transfer ports 9. One or several discharge ports 10, preferably placed opposite the transfer ports 9, allow the burnt gases to escape from the combustion chamber through the exhaust pipe(s) 11.

An ignition plug 13 placed at the level of the cylinder head allows the combustion to be initiated and maintained.

The cylinder head also comprises an air-blast fuel injection assembly including a valve 20 that seals intermittently a fuel mixture delivery port 12. The motion of valve 20 can be controlled by a cam 21 associated with a return spring 22, such as that shown in FIGS. 1 to 3. Any other device such as a pneumatic, hydraulic, magnetic . . . control can be used without departing from the scope of the invention. Similarly, the valve can be replaced by a rotary plug.

Upstream from valve 20, a container 15 and a delivery pipe 15*a* allow the fuel mixture to be stored at a certain pressure.

According to the invention, the container 15 also communicates with a mechanism 30-34 for inducting and introducing the fuel mixture into container 15.

More precisely, the induction mechanism comprises a delivery pipe 34 for secondary air to be carbureted, into which opens a conventional carburetor 30, the pipe 34 being equipped with a nonreturn device 31 located downstream from carburetor 30 and which communicates pipe 34 with one or several pipes 33. Pipe(s) 33 also opens into pump crankcase 5 via a port 33*b*.

Besides, an opening 33*a* equipped with a nonreturn valve 32 connects pipe 33 with storage 15.

This assembly works as follows: The secondary air used for feeding container 15 is first inducted through the secondary air delivery pipe 34 during an intake stroke of the engine. This air passes through the carburetor 30 which delivers a very rich mixture, then through the nonreturn device 31. The fuel mixture is thus allowed to pass into pipe 33.

The length and/or the volume of pipe 33 are so calculated that the fuel mixture cannot reach the pump crankcase 5 when the crankcase compression starts (beginning of the piston downstroke). Then the piston, while moving down, compresses the pump crankcase and the fuel mixture present in pipe 33. This fuel mixture is then transferred into container 15 via the nonreturn valves 32.

It is important that the volume transferred from pipe 33 to container 15 is greater than or equal to the volume transferred from the secondary air delivery pipe 34 to pipe 33, so that the fuel does not reach the pump crankcase and is therefore not likely to mix with the air inducted to in the pump crankcase through the main air inlet 7, which will serve for scavenging via transfer pipes 8 and openings 9.

The engine according to the invention can thus work with a conventional carburetor (apart from the fact that it is calibrated to give a very rich mixture) used under normal intake and compression conditions.

By way of example, if 15% of the air charge admitted in the combustion chamber comes from the air-blast injection device, one will have to dimension:

on the one hand, the secondary intake so that it delivers less than 15%, for example only 10% of the total air consumed by the engine. This means that the carburetor will have to supply a fuel mixture at a ratio about 5 to 10 times as high as that desired in the combustion chamber, on the other hand, the volume of pipe 33 must be sufficient so that the fuel mixture, which represents in this example 10% of the air charge, cannot reach the pump crankcase.

On the other hand, the geometry of pipe 33 will be such that it will prevent at best the carbureted part inducted in pipe 33 to mix with the air charge initially present in pipe 33. This can be obtained for example with a rather long pipe 33 of constant section.

FIG. 2 shows another embodiment of the invention which additionally comprises a supple separation membrane 35 placed in pipe 33 and whose displacements (translation along the axis of pipe 33) are related to the pressure variations in the pump crankcase 5. Thus, during the main air intake in crankcase 5, i.e. when piston 2 carries out an upstroke, then membrane 35 moves down, it is inducted towards crankcase 5. Because membrane 35 divides pipe 33 into a lower volume 33*d* connected to the pump crankcase 5 and an upper volume 33*c* connected to container 15, when induction into the crankcase occurs, volume 33*d* decreases and volume 33*c* increases.

According to this embodiment, the fuel mixture is thus materially prevented from reaching the pump crankcase 5.

As a result, membrane 35 allows a characteristic function of the invention to be achieved, i.e. the induction and the introduction of the fuel mixture under pressure in container 15, and moreover a mixing between the uncarbureted air of pump crankcase 5 (or more generally the gas) and the fuel mixture is here materially impossible. There will be no fuel (even in the form of traces) in crankcase 5 such as fuel that might take part in the scavenging of the cylinder and thus reach the exhaust without being burned.

According to this embodiment of the invention, it is no longer necessary to maintain a certain volume or a certain length (whose purpose was to prevent the mixing of the carbureted gas and of air) of pipe 33. Advantageously, the volume of pipe 33 will even be as low as possible. In the extreme, membrane 35 could be placed directly on the periphery of the pump crankcase.

FIG. 3 shows an embodiment that differs from FIG. 1 in the point of connection of pipe 33 on the pump crankcase 5 side.

In fact, according to this embodiment of the invention, pipe 33 is no longer directly connected to the pump crankcase 5, but this connection with the pump crankcase is ensured via a port 33*e* located in the lower part of the cylinder and sealed intermittently by piston 2. Port 33*e* is preferably sealed in proximity to the opening of the transfer ports until the proximity of the closing of the transfer ports. The pressure in pipe 33 thus varies between the minimum pressure of the crankcase (close to the top dead center) and the pressure at the opening of the transfer ports (OT). With this embodiment of the invention it has been observed that the pressure difference between the crankcase pressure at OT and the minimum crankcase pressure was proportional to the engine load. The fuel mixture pumped by the device according to the invention can thus be proportional to the engine load, which facilitates the control of the fuel flow rate 10 by a simple carburetor type system.

Of course, the embodiments of FIGS. 2 and 3 can be combined without departing from the scope of the invention, i.e. there can be at the same time a connection at 33*e* as shown in FIG. 3 and a separation membrane 35 such as shown in FIG. 2.

Figure 4:
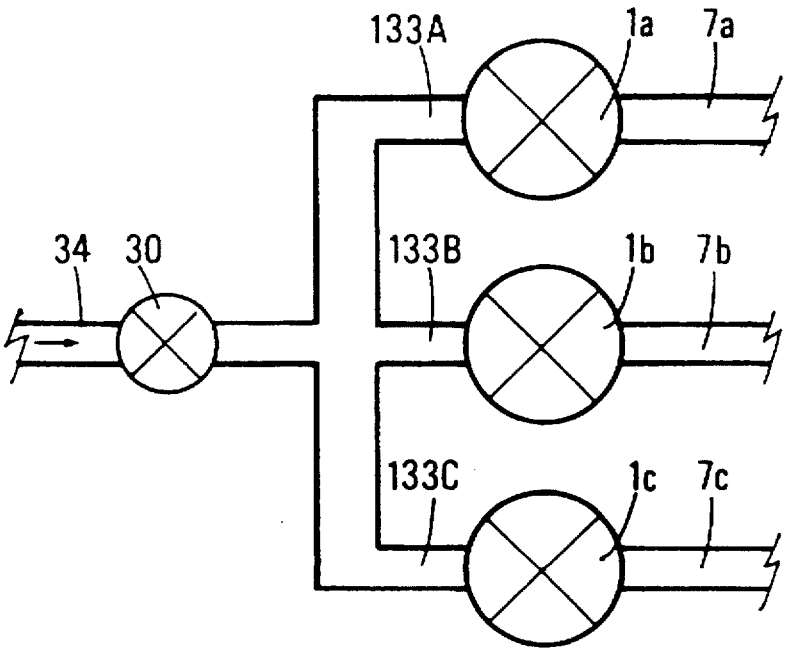
FIG. 4 shows a schematic cross-section of the application of the invention to a multicylinder engine.

Finally, in the case of a multicylinder engine, each cylinder can be equipped with its own carburetion system according to the invention, but another solution can consist in using, as shown in FIG. 4, a single carburetor for all the cylinders.

More precisely, there will thus be a single secondary delivery pipe 34, a single carburetor 30, then, downstream from the carburetor, pipe 34 divides into as many pipes as there are cylinders in the engine, each pipe being connected to a linking pipe (133A, 133B, 133C) between the pump crankcase and the container.

We claim:

1. A two-stroke engine with air-blast fuel injection comprising at least one cylinder in which moves a piston defining a combustion chamber and a pump crankcase forming a continuation of the combustion chamber and separated therefrom by the piston, at least one main air inlet in the pump crankcase, a device for introducing a fuel mixture under pressure including a control controlling opening and closing of a port for introducing the fuel mixture into the combustion chamber, a container, connected to the port and containing the fuel mixture under pressure, and a mechanism for inducting and introducing the fuel mixture under pressure into the container; and wherein the mechanism for inducting and introducing the fuel mixture under pressure into the container comprises a secondary air delivery pipe, into which opens a carburetor, and equipped with a nonreturn device placed downstream from the carburetor, the secondary air delivery pipe opening, downstream from the nonreturn device, into at least one pipe connecting the container to the pump crankcase and a second nonreturn device disposed between the container and the at least one pipe.

2. An engine as claimed in claim 1, wherein the secondary air delivery pipe opens into the at least one pipe adjacent the container.

3. An engine as claimed in claim 2, wherein the at least one pipe opens at an end opposite an end opening into the container, directly into the pump crankcase.

4. An engine as claimed in claim 2, wherein the at least one pipe opens at an end opposite an end opening into the container into a port of the at least one cylinder cooperating at certain periods of a working cycle with an opening of each piston.

5. An engine as claimed in claim 1 wherein the secondary air delivery pipe has dimensions defining a volume of inducted fuel mixture which remains lower than a volume of the at least one linking pipe which prevents the fuel mixture from being driven back into the pump crankcase.

6. An engine as claimed in claim 2 wherein the secondary air delivery pipe has dimensions defining a volume of inducted fuel mixture which remains lower than a volume of the at least one linking pipe which prevents the fuel mixture from being driven back into the pump crankcase.

7. An engine as claimed in claim 3 wherein the secondary air delivery pipe has dimensions defining a volume of inducted fuel mixture which remains lower than a volume of the at least one linking pipe which prevents the fuel mixture from being driven back into the pump crankcase.

8. An engine as claimed in claim 4 wherein the secondary air delivery pipe has dimensions defining a volume of inducted fuel mixture which remains lower than a volume of the at least one linking pipe which prevents the fuel mixture from being driven back into the pump crankcase.

9. An engine as claimed in claim 5 wherein the volume of the at least one pipe is greater than volume occupied by an inducted fuel mixture necessary for each engine revolution.

10. An engine as claimed in claim 6 wherein the volume of the at least one pipe is greater than volume occupied by an inducted fuel mixture necessary for each engine revolution.

11. An engine as claimed in claim 7 wherein the volume of the at least one pipe is greater than volume occupied by an inducted fuel mixture necessary for each engine revolution.

12. An engine as claimed in claim 8 wherein the volume of the at least one pipe is greater than volume occupied by an inducted fuel mixture necessary for each engine revolution.

13. An engine as claimed in claim 1, further comprising a lubricant supply for introducing lubricant simultaneously with air from the at least one main air inlet.

14. An engine as claimed in claim 1, wherein the at least one pipe includes a supple separation membrane which is displaceable and having displacements depending on pressure in the crankcase.

15. An engine as claimed in claim 1, further comprising a single secondary air delivery pipe, a single carburetor, and the at least one pipe feeds a plurality of pipes each cooperating with a different cylinder.

16. An engine as claimed in claim 2, further comprising a lubricant supply for introducing lubricant simultaneously with air from the at least one main air inlet.

17. An engine as claimed in claim 2, wherein the at least one pipe includes a supple separation membrane which is displaceable and having displacements depending on pressure in the crankcase.

18. An engine as claimed in claim 2, further comprising a single secondary air delivery pipe, a single carburetor, and the at least one pipe feeds a plurality of pipes each cooperating with a different cylinder.

19. An engine as claimed in claim 3, further comprising a lubricant supply for introducing lubricant simultaneously with air from the at least one main air inlet.

20. An engine as claimed in claim 3, wherein the at least one pipe includes a supple separation membrane which is displaceable and having displacements depending on pressure in the crankcase.

* * * * *